United States Patent [19]

Pittman

[11] 3,962,600

[45] June 8, 1976

[54] AMBIENT LIGHT RESPONSIVE ILLUMINATION BRIGHTNESS CONTROL CIRCUIT

[75] Inventor: Carl R. Pittman, Columbus, Ind.

[73] Assignee: Arvin Hong Kong Ltd., Columbus, Ind.

[22] Filed: Feb. 14, 1975

[21] Appl. No.: 549,913

[52] U.S. Cl. ..... 315/158; 250/206; 315/159

[51] Int. Cl.[2] ..... H05B 39/04

[58] Field of Search ..... 315/149–159; 250/214 R, 214 D, 206, 214 AL; 58/50 R; 307/311

[56] References Cited

UNITED STATES PATENTS

| | | | |
|---|---|---|---|
| 3,366,834 | 1/1968 | Potter | 315/158 X |
| 3,401,,265 | 9/1968 | Dotto | 315/149 X |

OTHER PUBLICATIONS

Solid State Products, Inc., *New Design Ideas*, No. 7, "Light Sensor for High Level Digital Readout." Electronics, Dec. 6, 1963, pp. 56–58.

*Primary Examiner*—Siegfried H. Grimm
*Attorney, Agent, or Firm*—Jenkins, Hanley & Coffey

[57] ABSTRACT

A circuit for automatically changing the amount of light provided by an illuminating source which contains a light sensitive device for monitoring the ambient light level. The light sensitive device controls current flow through a first path which includes the illumination source. A second path also provides current flow through the illumination source. When current is flowing through both paths, the source emits a predetermined amount of light. When only the second path conducts, the light provided by the illuminating source is substantially decreased.

9 Claims, 7 Drawing Figures

AMBIENT LIGHT RESPONSIVE ILLUMINATION BRIGHTNESS CONTROL CIRCUIT

BACKGROUND OF THE INVENTION

In many applications, it is desirable to provide an illuminating source with a control system for automatically varying the intensity of the illumination provided by the source in response to variations in the ambient light level. For example, a digital or analog clock generally contains a light source in close proximity to the clock face or digital readout to facilitate reading of the time in a darkened room. The light source may be positioned in front of the face to provide for reading of the clock or digital display in reflected light therefrom. The light source may be behind a transparent or translucent digital display or clock face to allow the observer to read the time by the light transmitted through the digital display or clock face. In some clocks and clock radios, the time may be displayed on a digital readout tube, selected elements of which are made to glow corresponding to the different numbers.

In many such applications, no provision is made for decreasing the intensity of the light emitted by the illuminating source to light the clock. However, the light continuously emitted from the clock face or digital display may prove disturbing to, for example, the observer who has so situated the clock so that it may be read from a bed. As a result, the light from the clock may prove disturbing to the observer who may be attempting to sleep with the light from the clock shining in his face. In some cases, the light sources provided for such clocks have manual adjustments for decreasing the intensity of the emitted light.

A major disadvantage with such manual adjustments, of course, is that if the observer adjusts the light intensity so that it is least distracting when the room is dark, he may find it difficult or impossible to read the clock when the ambient light level in the room is high. Conversely, if he adjusts the clock for high light output to enable him to read the clock during periods of increased room light, the clock light output is excessively bright and distracting when he is trying to sleep. Thus, the clock light output requires constant adjustment for ambient light for the comfort and reading ease of the observer.

SUMMARY OF THE INVENTION

In accordance with the invention, a controllable illuminating system comprises a power supply, a pair of terminals adapted to be coupled to the power supply, illuminating means coupled to one of the terminals, and control means coupled to the illuminating means and to the other one of the pair of terminals. The control means are responsive to the ambient light level where said control means are located for varying the power supplied to the illuminating means. The control means thereby vary the intensity of illumination emitted from the illuminating means in response to the ambient light level.

BRIEF DESCRIPTION OF THE DRAWINGS

The invention may best be understood by referring to the following description and accompanying drawings of which.

DETAILED DESCRIPTION OF THE PREFERRED EMBODIMENT

Figure 1:
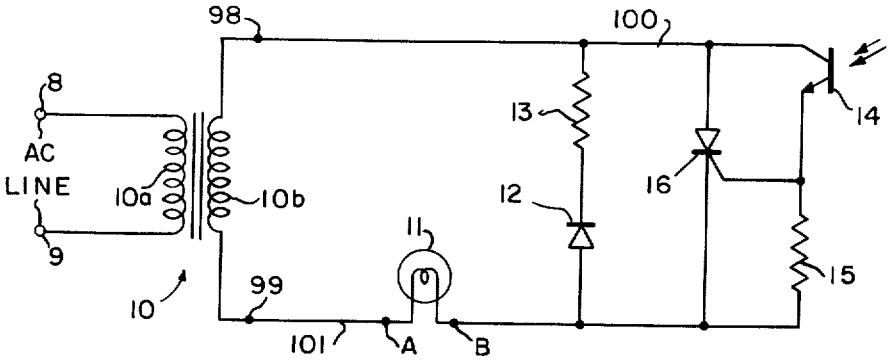
FIG. 1 is a schematic circuit diagram of a first circuit embodying the present invention.

In FIG. 1, a source of alternating current voltage such as, for example, the 120 volt alternating current line voltage is coupled across terminals 8–9 of a primary winding 10*a* of a transformer 10. A secondary winding 10*b* of transformer 10 is coupled at a first terminal 98 to a conductor 100 and at a second terminal 99 to a conductor 101.

A pair of terminals A and B of a lamp 11, a diode 12 and a resistor 13 are coupled in series between conductors 100 and 101. Diode 12 is poled for conduction when conductor 101 is positive with respect to conductor 100. The anode of a silicon controlled rectifier (SCR) 16 is coupled to conductor 100. Its cathode is coupled to the junction of the anode of diode 12 and terminal B of lamp 11.

The collector of a light sensitive transistor or phototransistor 14 is also coupled to conductor 100. The emitter of phototransistor 14 is coupled through a series resistor 15 to terminal B of lamp 11. The gate electrode of SCR 16 is coupled to the emitter of phototransistor 14.

In the operation of the circuit of FIG. 1, when alternating current voltage variations are applied across terminals 8–9 of primary winding 10*a*, similar alternating current voltage variations appear across secondary winding 10*b* between conductors 100 and 101. Voltage variations cause current to flow from terminal A to terminal B of lamp 11, through diode 12 and resistor 13 as conductor 101 becomes positive with respect to conductor 100. This current flow causes light to be emitted from lamp 11.

The amount of light emitted from lamp 11 as current flows in this first direction is a function of the amount of current flow through said lamp, the maximum value of which may be set by choosing the proper value for resistor 13. The lower the resistance of resistor 13, the greater the current flow in this first direction through lamp 11, diode 12 and resistor 13. Increased current results in greater light output from lamp 11 as current flows in this first direction.

Current flow from the terminal B to terminal A through lamp 11 as conductor 100 becomes positive with respect to conductor 101 will occur if SCR 16 is in a conductive state. SCR 16 will be conductive if sufficient current is supplied to its gate electrode. Supplying this gate current is the function of phototransistor 14. If sufficient light is present where phototransistor 14 is located, phototransistor 14 will be conductive. As the light increases, the conduction of phototransistor 14 increases. Conversely, as the light illuminating phototransistor 14 decreases, the conduction of phototransistor 14 decreases. Thus, in bright light, phototransistor 14 will be highly conductive and the substantial current flowing from its emitter when conductor 100 is positive with respect to conductor 101 flows through the parallel combination of resistor 15 and the gate-to-cathode junction of SCR 16.

The portion of the current from the emitter of phototransistor 14 flowing through the gate electrode of SCR 16 will be sufficient to render SCR 16 conductive, causing current to flow through SCR 16 and from terminal B to terminal A of lamp 11 when conductor 100 is positive with respect to conductor 101.

When there is little or no ambient light striking phototransistor 14, little or no current flows from its emitter, and SCR 16 will not be rendered conductive. As a result, there is no current path from conductor 100 to conductor 101 when conductor 100 is positive with respect to conductor 101. Thus, no current flows from terminal B to terminal A of lamp 11 and no light is emitted by lamp 11. Since no light is emitted for the half of every cycle of alternating current voltage between conductors 100 and 101 when conductor 100 is positive with respect to conductor 101, the total amount of light emitted from lamp 11 decreases. As has been indicated, the minimum amount of light emitted can be set to any desired level by proper choice of the resistance value of resistor 13.

The total light emitted from lamp 11 is the sum of the light emitted when conductor 101 is positive with respect to conductor 100 and that emitted when conductor 100 is positive with respect to conductor 101. Thus, the circuit of FIG. 1 allows a maximum light to be emitted from lamp 11 when the ambient light level is high. When that ambient light level decreases to such an extent that phototransistor 14 does not supply enough current to render SCR 16 conductive, the light output from lamp 11 is at a minimum. Thus, the light emitted or reflected from a clock or digital display associated with lamp 11 is at a minimum.

Figure 5C:
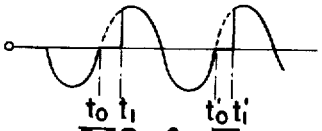
Figure 5A:
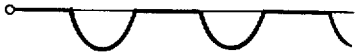

FIG. 5*a* illustrates the voltage waveform across terminals A and B and the current through a lamp 11 coupled between terminals A and B when SCR 16 is non-conductive. It may be seen that voltage is impressed across terminals A and B in only one direction, current flow in the other direction being inhibited by the reverse bias of diode 12 and by the non-conductive state of SCR 16, when conductor 100 is positive with respect to conductor 101.

Figure 5B:
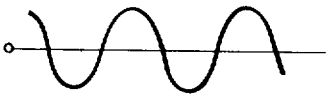

FIG. 5*b* illustrates the voltage waveform across terminals A and B and the current through lamp 11 when phototransistor 14 and SCR 16 are both in highly conductive states. As the waveform indicates, current is allowed to flow in both directions through lamp 11 as conductors 100 and 101 become alternately positive with respect to one another. Current flows in a first direction through lamp 11, diode 12 and resistor 13. Current flow in a second direction, which is blocked by diode 12 when phototransistor 14 and SCR 16 are non-conductive, is allowed through SCR 16 and lamp 11 with a slight contribution through resistor 15, when phototransistor 14 and SCR 16 are conductive.

As the waveforms of FIGS. 5*a* and *b* indicate, the voltage impressed across terminals A and B when conductor 100 is positive with respect to conductor 101, and thus the current flow through a lamp 11 coupled therebetween, is variable independently of the voltage impressed across terminals A and B and the current flow through lamp 11 when conductor 101 is positive with respect to conductor 100. As was previously mentioned, the amount of current flow from terminal A to terminal B is determined by the resistance of resistor 13 and the resistance between terminals A and B of lamp 11, while the current flow from terminal B to terminal A is determined largely by the resistance between terminals B and A of lamp 11.

Figure 2:
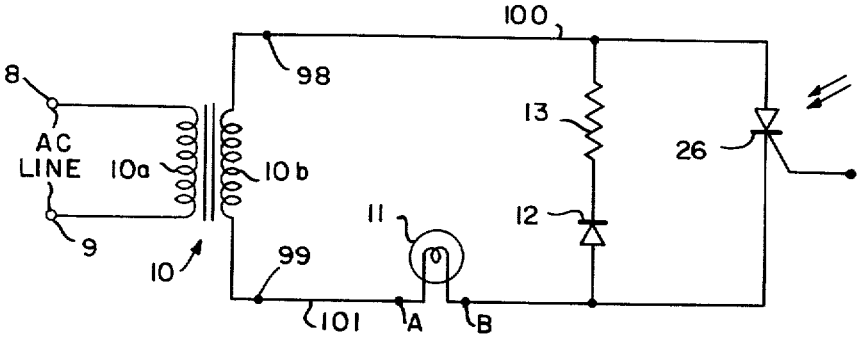
FIG. 2 is a schematic circuit diagram of a modified embodiment of the invention.

FIG. 2 illustrates an alternative embodiment of the invention in which those circuit elements which perform the same functions as those described in connection with FIG. 1 are labelled with the same letters and numbers.

In FIG. 2, phototransistor 14 and resistor 15 do not appear, and SCR 16 has been replaced by a light activated silicon controlled rectifier (LASCR) 26. The difference between the circuits of FIGS. 1 and 2 is that in place of an SCR (SCR 16 of FIG. 1) which is rendered conductive by operation of another device (phototransistor 14 of FIG. 1) in response to the ambient light level, a LASCR (LASCR 26) has been substituted. This substitution has made possible the elimination of phototransistor 14 of FIG. 1 because LASCR 26 of FIG. 2 is itself responsive to the ambient light level. Thus, when the ambient light striking LASCR 26 increases above a certain brightness level, LASCR 26 becomes conductive allowing current to flow through lamp 11. The current through lamp 11 when conductor 100 is positive with respect to conductor 101 provides an increase in the light output from lamp 11 as in the circuit of FIG. 1.

Again, the voltage and current waveforms at terminals A and B when LASCR 26 is non-conductive are illustrated in FIG. 5*a*. When LASCR 26 becomes conductive in response to increased room light, current is allowed to flow in both directions through lamp 11. When conductor 101 is positive with respect to terminal 100, current flows through lamp 11 from terminal A to terminal B, through diode 12 and resistor 13. When conductor 100 is positive with respect to conductor 101, current flows through LASCR 26 and lamp 11 from terminal B to terminal A. The voltage impressed across terminals A and B and the current flow therethrough when LASCR 26 is conductive are illustrated in FIG. 5*b*.

Figure 3:
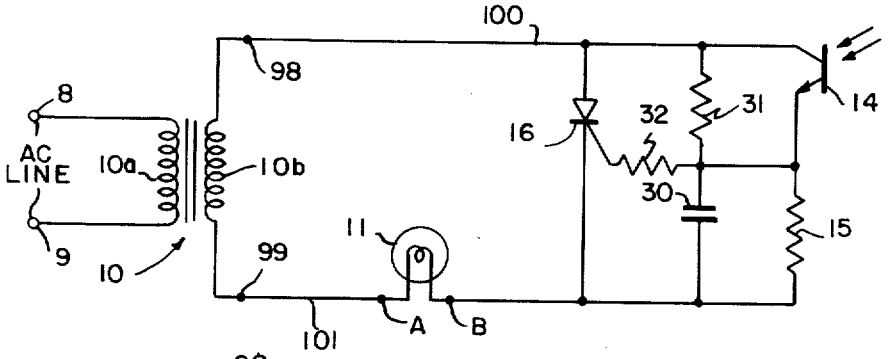
FIG. 3 is a schematic circuit diagram of another modified embodiment of the invention.

FIG. 3 illustrates another alternative embodiment of the invention in which those circuit elements numbered and lettered as in FIG. 1 perform the same functions as those described in connection with FIG. 1.

In FIG. 3, a capacitor 30 is coupled across resistor 15. A resistor 31 is coupled across the collector and emitter of phototransistor 14. A current limiting resistor 32 is coupled between the junction of capacitor 30 and resistor 31 and the gate electrode of SCR 16. In this embodiment, diode 12 and resistor 13 are not in the circuit. The function of diode 12 and resistor 13 in the circuits of FIGS. 1 and 2 is accomplished, in the embodiment of FIG. 3, by resistor 31 and capacitor 30.

As conductor 101 becomes positive with respect to conductor 100, capacitor 30 charges through resistor 31. The charging current for capacitor 30 flows from terminal A to terminal B through lamp 11, causing lamp 11 to emit light.

During the half-cycle of alternating current voltage in which conductor 101 goes negative with respect to conductor 100, if the ambient room light is not high enough to render phototransistor 14 conductive, capacitor 30 charges through resistor 31 until the voltage at the gate electrode of SCR 16 is sufficient to trigger SCR 16 into conduction. When SCR 16 is triggered, it continues to conduct for the remainder of the half-cycle of voltage during which conductor 101 is negative with respect to conductor 100. Capacitor 30 and resistor 31 act to shift the phase of the alternating current voltage impressed across them. The amount of phase shift, and thus the delay between the time at which conductor 100 goes positive with respect to conductor 101 and the time at which SCR 16 becomes conductive, is determined by the values of resistor 31 and capacitor 30.

When phototransistor 14 becomes conductive, however, it effectively places another resistance in parallel with resistor 31, decreasing the resistance between the junction of resistor 31 with capacitor 30 and conductor 100. This decreased resistance results in a different phase shift and a decreased time delay between the time at which conductor 100 becomes positive with respect to conductor 101 and the time at which SCR 16 becomes conductive.

This decreased time delay results in SCR 16 being conductive for a greater portion of each half-cycle of alternating current voltage in which conductor 100 is positive with respect to conductor 101 when phototransistor 14 is conductive. Increased conduction by SCR 16 results in increased current through lamp 11 and increased light output therefrom.

With reference to FIG. 5*c*, that portion of the waveform below the reference line illustrates current flow through lamp 11 of FIG. 3 from terminal A to terminal B and through resistor 31 to charge capacitor 30 when conductor 101 is positive with respect to conductor 100. That portion of the waveform of FIG. 5*c* above the reference line illustrates current flow through SCR 16 and lamp 11 from terminal B to terminal A when conductor 100 is positive with respect to conductor 101.

During each half-cycle of voltage across terminals 98 and 99 in which conductor 100 is positive with respect to conductor 101 and phototransistor 14 of FIG. 3 is non-conductive, capacitor 30 charges from the voltage across terminals 98 and 99 through resistor 31. After an amount of time indicated as $t_l$ and $t_l'$ of the positive half-cycles of voltage of FIG. 5*c*, the voltage at the junction of capacitor 30, resistor 31, and resistor 32 becomes sufficient to trigger SCR 16 into conduction.

As phototransistor 14 becomes conductive in response to increased ambient light, the resistance through which capacitor 30 charged during each positive half-cycle of voltage decreases. Thus, capacitor 30 charges more quickly to sufficient voltage to render SCR 16 conductive and SCR 16 conducts from a time nearer the beginning of each positive half-cycle of voltage, indicated in FIG. 5*c* by times $t_o$ and $t_o'$.

Thus, current is allowed to flow through lamp 11 from terminal B to terminal A for a greater portion of each positive half-cycle resulting in increased light output.

Figure 4:
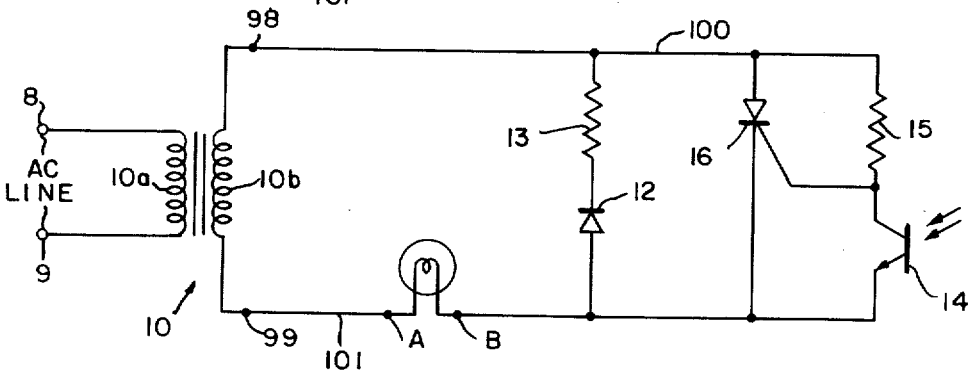
FIG. 4 is a schematic circuit of another modified embodiment of the invention; and, FIGS. 5*a* –*c* are illustrative waveforms obtained by using the circuits of FIGS. 1–4.

The embodiment of FIG. 4 is provided to show that the circuit components of FIG. 1 can be arranged to perform a function opposite that achieved by the component arrangement of FIG. 1. In the circuit of FIG. 4, the light emitted by lamp 11 increases as the ambient light in the room in which phototransistor 14 is located is reduced. Those components and terminals lettered and numbered as in FIG. 1 perform the same functions. It will be noted that the only structural distinction between the embodiment of FIG. 1 and that of FIG. 4 is that the positions of resistor 15 and phototransistor 14 are reversed. That is, resistor 15 in FIG. 4 is coupled between conductor 100 and the gate electrode of SCR 16, and the collector of phototransistor 14 is coupled to the gate electrode of SCR 16. The emitter electrode of phototransistor 14 is coupled to the junction of the cathode of SCR 16, the anode of diode 12 and terminal B of lamp 11.

The circuit of FIG. 4 functions to increase the light output of lamp 11 as the ambient room light decreases and decrease the light from lamp 11 as the ambient room light increases.

During the half-cycle of alternating current voltage across conductors 100 and 101 in which conductor 101 is positive with respect to conductor 100, the circuit of FIG. 4 functions just as the circuits of FIGS. 1 and 2. Current flows from conductor 101 through terminal A and lamp 11 to terminal B, through diode 12 and current limiting resistor 13 to conductor 100. Current flow through lamp 11 from terminal A to terminal B causes light to be emitted from lamp 11.

As conductor 100 becomes positive with respect to conductor 101, diode 12 becomes reverse biased. Assuming a sufficiently low ambient light level in the room in which the circuitry is located, phototransistor 14 will be in a non-conductive state and current will flow through resistor 15, the gate-cathode junction of SCR 16 and lamp 11. Since phototransistor 14 is non-conductive, all of the current in 15 will flow into the gate electrode of SCR 16 and will be sufficient to render SCR 16 conductive. Thus, current will flow through SCR 16 and from terminal B to terminal A of lamp 11 causing light to be emitted therefrom.

As the ambient light level is increased, the conduction of phototransistor 14 increases until at some level of conduction, the difference between the current through resistor 15 and that into the collector of phototransistor 14 will be insufficient to provide enough gate current to the gate of SCR 16 to render it conductive. At that point, SCR 16 will remain non-conductive during the entire half-cycle of alternating current voltage across conductors 100 and 101 in which conductor 100 is positive with respect to conductor 101. At that ambient light level, the only current flowing through lamp 11 from terminal A to terminal B when conductor 100 is positive with respect to conductor 101 will be the current through resistor 15 and phototransistor 14. This current is significantly less than the current through SCR 16 and lamp 11 when SCR 16 is conductive. Consequently, the light emitted by lamp 11 when SCR 16 is non-conductive, corresponding to a high ambient light level, is significantly reduced.

While the circuits disclosed have been described as being adapted for use to increase or decrease the light output of a digital or analog readout clock in response to the light level in the room in which the clock is located, it is to be understood, of course, that the disclosed circuits may be adapted for other uses in which it is desired to control the intensity of a light source in response to ambient light conditions.

What is claimed is:

1. A controllable illuminating system comprising a power supply, a pair of terminals adapted to be coupled to said power supply, illuminating means coupled to one of said terminals, and control means coupled to said illuminating means and to the other of said pair of terminals, said control means having a diode coupled for inducing current flow of a first polarity from one of said terminals through said illuminating means and light sensitive circuit means coupled for controllably inducing current flow of opposite polarity from one of said terminals through said illuminating means in response to the ambient light level where said control means is located for varying the power supplied to said illuminating means thereby varying the intensity of illumination emitted from said illuminating means in response to said ambient light level.

2. A controllable illuminating system according to claim 1 wherein said illuminating means and said control means are coupled in series between said pair of terminals.

3. A system according to claim 1 wherein said light sensitive circuit means includes a light sensitive transistor.

4. A system according to claim 1 wherein said light sensitive circuit means includes a light activated silicon controlled rectifier.

5. A controllable illuminating system according to claim 1 wherein said light sensitive circuit means comprises a silicon controlled rectifier coupled for inducing current flow of opposite polarity from one of said terminals through said illuminating means when said silicon controlled rectifier is placed in condition for conduction, and a light sensitive transistor coupled in the gate electrode circuit of said silicon controlled rectifier for controlling the conduction of said silicon controlled rectifier in response to said ambient light level.

6. A controllable illuminating system according to claim 1 wherein said light sensitive circuit means comprises a light activated silicon controlled rectifier for inducing current flow of opposite polarity from one of said terminals through said illuminating means when said light activated silicon controlled rectifier is placed in condition for conduction in response to ambient light levels in excess of a predetermined ambient light level.

7. A controllable illuminating system comprising a power supply; a pair of terminals adapted to be coupled to said power supply; illuminating means coupled to one of said terminals; and control means coupled to said illuminating means and to the other of said pair of terminals, said control means having a diode coupled for inducing current flow of a first polarity from one of said terminals through said illuminating means, a silicon controlled rectifier coupled for inducing current flow of opposite polarity from one of said terminals through said illuminating means when said silicon controlled rectifier is placed in condition for conduction, and a light sensitive transistor coupled in the gate electrode circuit of said silicon controlled rectifier for controlling the conduction of said silicon controlled rectifier in response to ambient light level thereby varying the intensity of illumination emitted from said illuminating means in response to ambient light level.

8. A controllable illuminating system comprising a power supply; a pair of terminals adapted to be coupled to said power supply; illuminating means coupled to one of said terminals; and control means coupled to said illuminating means and to the other of said pair of terminals, said control means having a diode coupled for inducing current flow of a first polarity from one of said terminals through said illuminating means, and a light activated silicon controlled rectifier for inducing current flow of opposite polarity from one of said terminals through said illuminating means when said light activated silicon controlled rectifier is placed in condition for conduction in response to ambient light levels in excess of a predetermined ambient light level to thereby vary the intensity of illumination emitted from said illuminating means in response to ambient light level.

9. A controllable illuminating system comprising a power supply; a pair of terminals adapted to be coupled to said power supply; illuminating means coupled to one of said terminals; and control means coupled to said illuminating means and to the other of said pair of terminals, said control means having a series resistance and capacitance so that current flow of a first polarity charges said capacitance through said resistance to illuminate said illuminating means, a silicon controlled rectifier connected in parallel with said resistance and capacitance for inducing current flow of an opposite polarity when placed in condition for conduction, and a light sensitive transistor coupled in the gate electrode circuit of said silicon controlled rectifier and in parallel with said resistance so that current flow of an opposite polarity charges said capacitance through said resistance to control the conduction of said silicon controlled rectifier, said light sensitive transistor being responsive to ambient light levels to cause said capacitance to charge through said resistance and said transistor when said ambient light exceeds a predetermined level to further control the conduction of said silicon controlled rectifier, and thereby vary the intensity of illumination of said illuminating means in response to ambient light level.

* * * * *